US006874389B1

(12) United States Patent
Thornton

(10) Patent No.: US 6,874,389 B1
(45) **Date of Patent: *Apr. 5, 2005**

(54) AUTOMATED PILL BOTTLE OPENER

(76) Inventor: Verdell Thornton, 5386 Alum Rock Ave., San Jose, CA (US) 95127

( * ) Notice: Subject to any disclaimer, the term of this patent is extended or adjusted under 35 U.S.C. 154(b) by 0 days.

This patent is subject to a terminal disclaimer.

(21) Appl. No.: 10/621,984

(22) Filed: Jul. 16, 2003

(51) Int. Cl.[7] ..... B07B 7/00
(52) U.S. Cl. ..... 81/3.2; 81/3.25; 81/3.31
(58) Field of Search ..... 81/3.2, 3.25, 3.29, 81/3.31–3.33, 3.36, 3.37, 63.1

(56) References Cited

U.S. PATENT DOCUMENTS 6,148,692 A * 11/2000 Russell ..... 81/3.2
6,182,534 B1 * 2/2001 Hardman ..... 81/3.2
6,651,531 B1 * 11/2003 Thornton ..... 81/3.2

* cited by examiner

*Primary Examiner*—Joseph J. Hail, III
*Assistant Examiner*—David B. Thomas
(74) *Attorney, Agent, or Firm*—The Kline Law Firm

(57) ABSTRACT

An automated pill bottle opener that is initiated by the user placing the bottle to be opened on a lower gripping surface that is affixed to a casing of the device. The user then moves a selector to choose the opening operation. A plunger assembly drives a plunger downward until a top gripping surface of a rotator assembly presses on the top of the bottle cap. After the pill bottle cap is opened, a pressure sensitive triggering device reverses the direction of travel of the plunger so that the plunger is again raised to its original position. To reseal a bottle, the user simply places the bottle on the lower gripping surface with the cap positioned on the top of the bottle. The user then moves the selector to choose the closing process. The plunger action of the device is identical, but the direction of rotation of the rotator is reversed so that the cap is screwed back onto the bottle.

7 Claims, 5 Drawing Sheets

AUTOMATED PILL BOTTLE OPENER

BACKGROUND OF THE INVENTION

1. Field of the Invention

The present invention relates generally to household appliances, and more particularly is an automated pill bottle opener that operates by pushing down on the cap of the pill bottle, rotating the cap relative to the bottle, and then resealing the bottle after it has been used.

2. Description of the Prior Art

The people who need medicine the most are often ill equipped to obtain it. Some medicine bottles can be quite difficult to open if the person trying to open the bottle does not have full use of both hands. As we age and are more and more likely to need medicines, our dexterity may well be impaired by any of several causes—strokes, arthritis, injuries, Parkinson's disease, bursitis, and tendinitis are but a few of the conditions that can limit manual dexterity.

Since there are so many people who might need assistance in opening pill bottles, the prior art includes several examples of devices directed to this function. There are at least two references that disclose a means to press down on the top of a pill bottle cap while twisting the cap. One is the "APPARATUS FOR REMOVING A SAFETY CAP FROM A SAFETY CONTAINER" by Anderson, U.S. Pat. No. 5,735,181, issued Apr. 7, 1998. Another is the "HAND-HELD CAP OPENER FOR CHILD RESISTANT CONTAINERS" by Mikan et al., U.S. Pat. No. 4,770,069, issued Sep. 13, 1988. Both of these devices require the user to supply the power to open the bottle. In fact, the Mikan device would seem to require two hands to operate.

There are also references in the prior art that are related to a device that improves the user's grip on the cap. One such device is the "SELF-GRIPPING CAP REMOVER FOR CHILD RESISTANT MEDICATION CONTAINERS" by Trick et al., U.S. Pat. No. 4,760,763, issued Aug. 2, 1988, and another is the "GRIPPER FOR CONTAINER CAPS" by Allen, U.S. Pat. No. 4,702,129, issued Oct. 27, 1987. These devices enlarge the surface area that can be gripped, and provide better friction on the cap. However, the user must still supply the power to actually open the cap.

There are also references in the prior art that essentially just provide a better means of gripping. Two references of this type are the "ONE-HANDED CHILDPROOF MEDICINE BOTTLE OPENER" by Laudani, U.S. Pat. No. 6,205,888, issued Mar. 27, 2001, and the "PILL BOTTLE CAP REMOVAL DEVICE" by Hystead, U.S. Pat. No. 5,836,221, issued Nov. 17, 1998. The Laudani device provides a mechanism to hold the lower end of the bottle securely in place, and the Hystead device provides a device to grip the cap. Two other references that provide mechanical means to improve a grip on the cap of a bottle are the "MULTI-PURPOSE HAND TOOL" of Penaligon et al., U.S. Pat. No. 5,621,936, issued Apr. 22, 1997, and the "CHILD RESISTANT CONTAINER OPENER" of Silliman, U.S. Pat. No. 4,073,205, issued Feb. 14, 1978.

There are several devices in the prior art that just aid the user in prying the cap off the bottle. Among these are the "REMOVER FOR CHILD RESISTANT CLOSURE" by Garby et al., U.S. Pat. No. 5,313,859, issued May 24, 1994; the "CONTAINER OPENING TOOL" of Ross, U.S. Pat. No. 5,388,297, issued Feb. 14, 1995; the "TOOL FOR REMOVING CAPS FROM CONTAINERS" of Evans, U.S. Pat. No. 3,885,478, issued May 27, 1975; and the IMPLEMENT FOR OPENING SEALED CONTAINERS" by Joyce, U.S. Pat. No. 2,702,652, issued Feb. 22, 1955.

The prior art does disclose efforts directed to actual removal of a lid. The "JAR LID REMOVER" of Sartell et al., U.S. Pat. No. 5,370,019, shows a device that automatically removes a jar lid. However, this device would not appear to work on a pill bottle, as there is no means of applying a downward force to the top of the bottle cap.

Accordingly, it is an object of the present invention to provide a device that enables a user to open a pill bottle with minimal hand strength and dexterity.

It is a further object of the present invention to provide a device that can apply a downward force while rotating the cap.

Another object of the present invention is to provide a device that will reseal the pill bottle after it has been used.

SUMMARY OF THE INVENTION

The present invention is an automated pill bottle opener. To initiate an opening operation, the user simply places the bottle to be opened on a lower gripping surface that is affixed to a casing of the device. The user then moves a selector in a first direction.

A plunger assembly drives a plunger downward until a top gripping surface of a rotator assembly presses on the top of the bottle cap. As the top gripping surface of the rotator engages the cap, the rotator begins to rotate so that the cap turns with the rotator. As pressure is applied to the top of the cap, frictional contact of the bottom of the bottle with the lower gripping surface inhibits the bottle from rotation while the opener is operating on the cap. After the locking mechanism of the pill bottle cap is released, a pressure sensitive triggering device reverses the direction of travel of the plunger so that the plunger is again raised to its original position.

The automated pill bottle opener of the present invention also provides the user the capability of putting the cap back on the pill bottle as well. To do so, the user simply places the bottle to be resealed on the lower gripping surface with the cap positioned on the top of the bottle. The user then moves the selector in a second direction opposite to that of the direction moved to initiate the opening process. The plunger action of the device is identical, but the direction of rotation of the rotator is reversed so that the cap is latched back onto the bottle.

An advantage of the present invention is that the user does not need to grip the bottle cap to open the bottle.

Another advantage of the present invention is that essentially all the motive power for opening the bottle cap is supplied by the device.

A still further advantage of the present invention is that the device will also replace the cap on the bottle.

These and other objects and advantages of the present invention will become apparent to those skilled in the art in view of the description of the best presently known mode of carrying out the invention as described herein and as illustrated in the drawings.

DETAILED DESCRIPTION OF THE INVENTION

Figure 2:
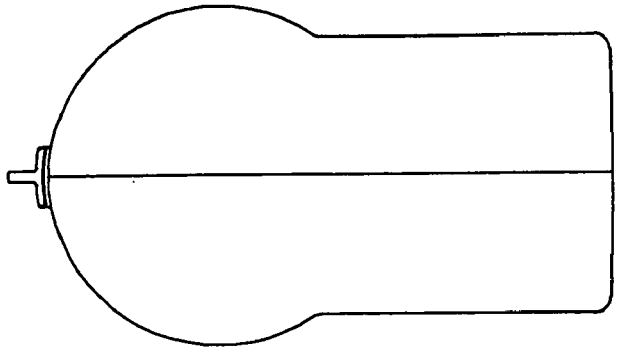
FIG. 2 is a top view of the automated pill bottle opener.
Figure 1:
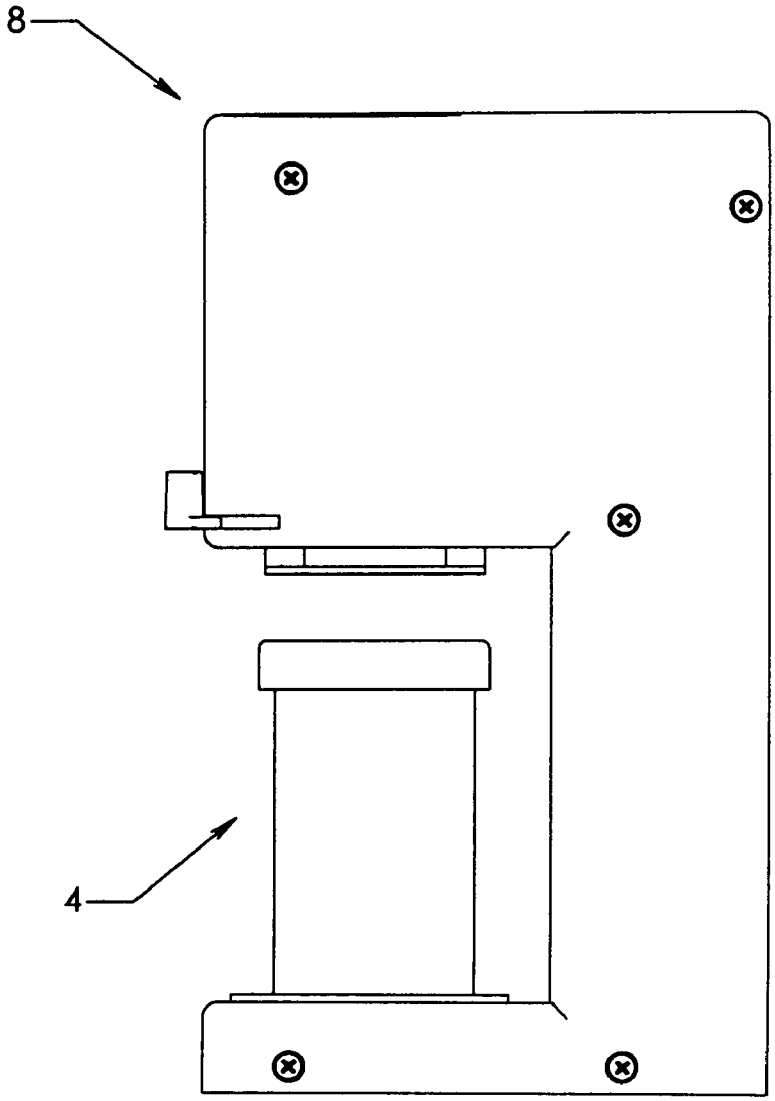
FIG. 1 is a side view of the automated pill bottle opener of the present invention.
Figure 3:
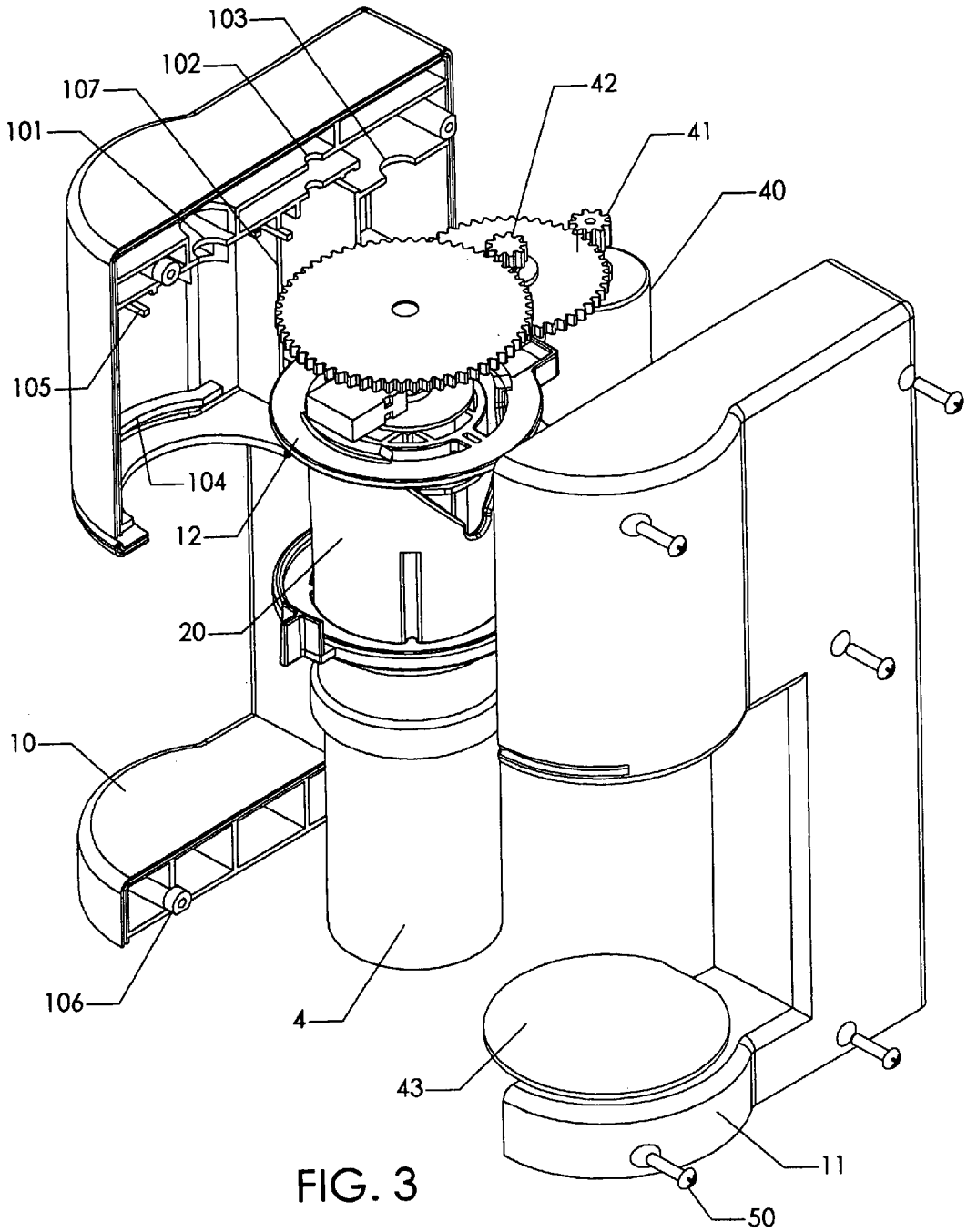
FIG. 3 is a partially exploded perspective view of the bottle opener.
Figure 5:
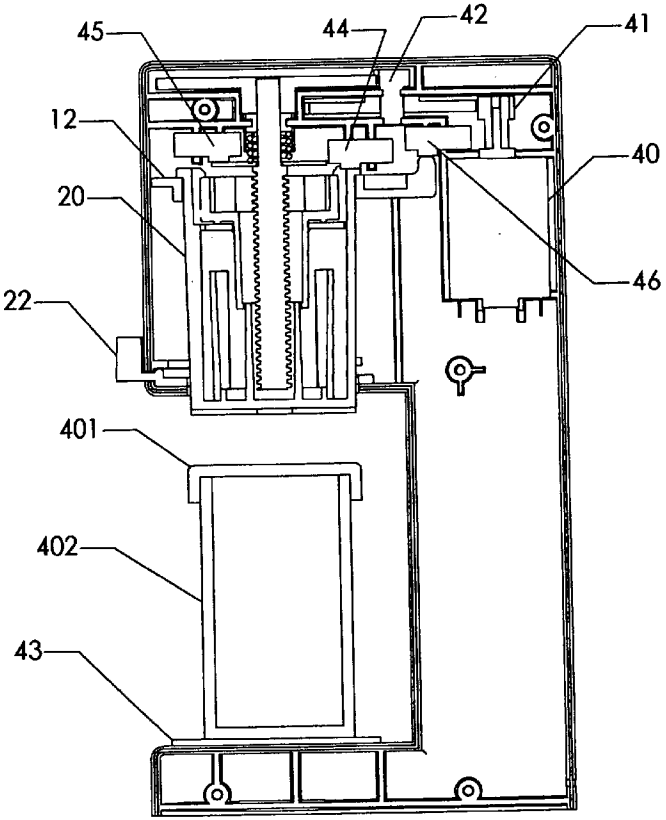
FIG. 5 is a sectional view taken along line 5—5 in FIG. 4.
Figure 4:
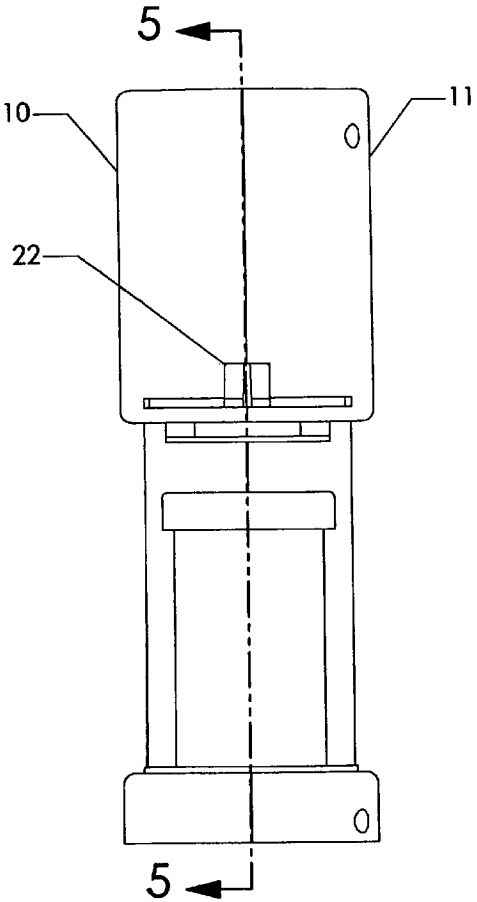
FIG. 4 is a front view of the bottle opener.
Figure 9:
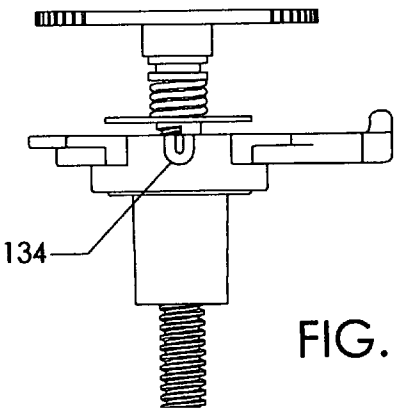
FIG. 9 is a sectional view taken along line 9—9 in FIG. 7.
Figure 8:
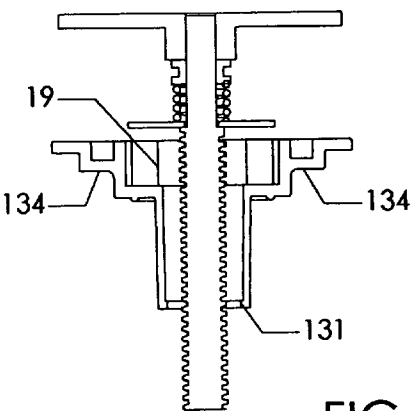
FIG. 8 is a sectional view taken along line 8—8 in FIG. 6.

Referring first to FIGS. 1–5, the present invention is an automated pill bottle opener 8 that opens and reseals a pill bottle 4. The device comprises a casing with a left half 10 and a right half 11. The left half 10 and the right half 11 of the casing are mirror images of each other, with the exception of the fastening elements that join the two halves, the screw holes 106 and the screws 50. Thus, the elements immediately following are formed by the joining of a first half of the named component in the left half 10 and a second half of the named component in the right half 11.

The components of the casing serve chiefly as retaining elements for the moving parts of the device. Each casing half 10, 11 comprises one half of a flanged bearing retainer 101, an intermediate gear retainer 102, a motor retainer 103, a selector retainer 104, and a switch retainer 105. In addition, each casing half 10, 11 comprises an anti-rotation rib 107.

The bottle opener 8 comprises two main working assemblies—the plunger assembly 12, and the rotator assembly 20— which are both powered by an electric drive motor 40 through a gear drive comprising a motor gear 41, an intermediate gear 42, and a plunger gear 18. Travel of the plunger assembly 12 is controlled by three switches: a start switch 44, a reverse switch 45, and a stop switch 46. Direction of rotation of the rotator assembly 20 is controlled by a selector 22 that can be moved in either of two directions from a central home position.

The plunger assembly 12 is shown in greater detail in FIGS. 6–9. The plunger assembly 12 comprises a plunger body 13 mounted on a flanged bearing 17 secured to a central shaft 14. The plunger 13 is driven up and down on a threaded lower segment of the shaft 14 by a driving nut 19 that is secured in a center of the plunger 13. A fender washer 15 mounted above the plunger 13 on top of the non-threaded portion of shaft 14 serves to reverse the direction of the drive motor 40 by contacting reverse switch 45 when the shaft 14 is forced upward when the plunger 13 reaches the lower end of its stroke. An overload spring 16 is mounted on top of the washer 15 to ensure that the shaft 14 is not forced upward until the shaft 14 reaches the bottom of its stroke. Upward travel of the shaft 14 is minimal, to ensure that the alignment of the plunger gear 18 with the intermediate gear 42 is not jeopardized. In the preferred embodiment, the travel distance of the shaft 14 relative to the casing is 0.020".

The plunger 13 itself is formed with a downward protruding alignment means 131 that guarantees that the plunger assembly 12 is properly aligned relative to the rotator assembly 20. A protruding anti-rotation means 132 contacts the anti-rotation ribs 107 on the casing to prevent the plunger 13 from rotating relative to the casing of the bottle opener 8.

A protruding switch activation tab 133 contacts the stop switch 46 when the plunger has returned to its home position. When the stop switch 46 closes, the electric drive motor 40 is stopped.

Figure 7:
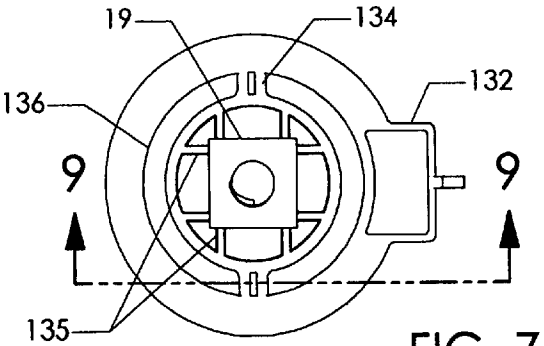
FIG. 7 is a sectional view taken along line 7—7 in FIG. 6.
Figure 6:
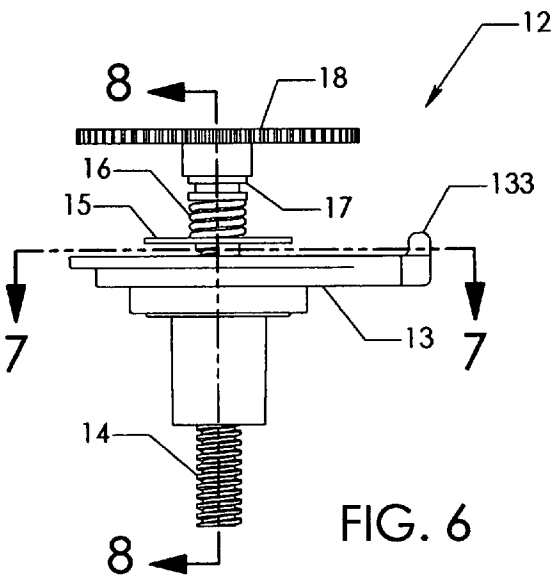
FIG. 6 is a side view of the plunger assembly.
Figure 13:
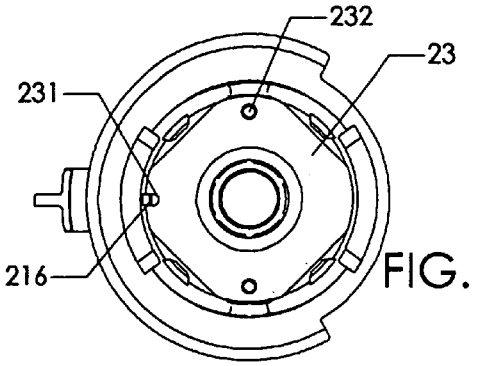
FIG. 13 is a top view of the rotator assembly.
Figure 10:
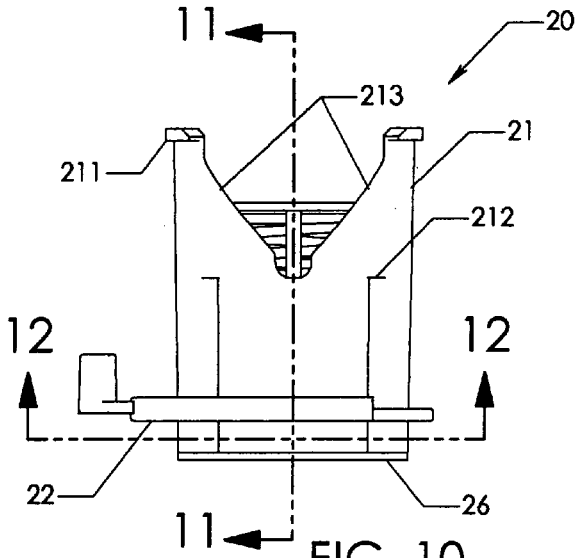
FIG. 10 is a side view of the rotator assembly.
Figure 11:
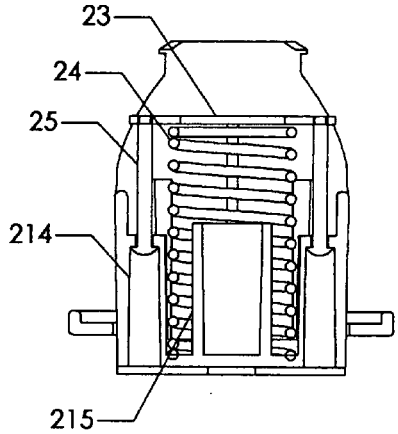
FIG. 11 is a sectional view taken along line 11—11 in FIG. 9.
Figure 12:
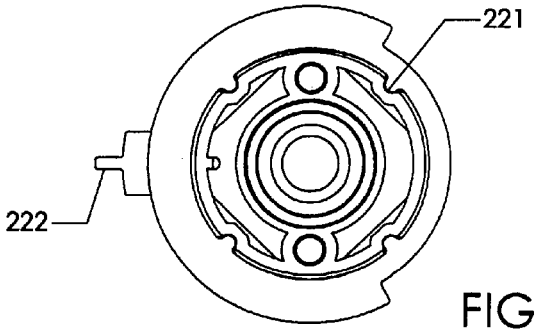
FIG. 12 is a sectional view taken along line 12—12 in FIG. 9.

As is most easily seen in FIG. 7, the plunger body 13 comprises an outer circumferential portion joined by a pair of half round members 134 to an inner circular portion. The space between the outer circumferential portion and the inner circular portion defines a rotator cutout 136 that receives the rotator assembly 20. A plurality of support ribs 135 extend inward from the inner circular portion of the plunger 13 to secure the driving nut 19.

The rotator assembly 20 is illustrated in detail in FIGS. 10–13. A protruding lip 211 rests on an upper surface of the plunger 13 to support the rotator body 21. Four semicircular slots 212 are spaced about the outer circumference of the rotator body 21 to mate with the tabs 221 of the selector 22. The user can therefore rotate the rotator assembly 20 by pushing the lever 222 on the selector 22.

The exterior portion of the rotator body 21 further comprises a pair of opposing V-shaped cutouts 213 that serve as a track for the half round members 134 of the plunger assembly 12. During operation, the half round members 134 traverse the V-shaped cutouts 213 to define the stroke of the rotator assembly 20.

The rotator body 21 houses the element that provides the means to apply downward force for the bottle opener 8, the rotator spring 24. The rotator spring 24 is held in place by a spring retainer 23 that is secured by retaining screws 25 received in tapped holes 232. The retaining screws 25 are installed in countersunk holes 214. The countersunk holes 214 provide the vertical travel room required for the screws 25 when the plunger 13 is driven downward, thereby compressing spring 24.

As the plunger 13 is driven downward, and the rotator assembly 20 rotates, it is important that spring retainer 23 not rotate relative to rotator body 21. Such rotation would create excessive shear forces on retaining screws 25. Accordingly, a vertical guide rib 216 extend outward from an inner wall of rotator body 21, and meshes with an anti-rotation depression 231 on the spring retainer 23.

The lowermost element of the rotator assembly 20 is a top surface grip 26. The top surface grip 26 contacts the top of the pill bottle cap 401, and provides the frictional contact between the bottle opener 8 and the pill bottle 4. The top surface grip 26 is therefore optimally formed from a pliable material such as rubber.

To initiate an opening operation, the user simply places the bottle 4 to be opened on top of the casing of the opener so that the body of the bottle 402 rests on a lower gripping surface 43 that is affixed to the casing of the device. The user then moves the selector 22 in a first direction (to the left in the preferred embodiment) to initiate the pill bottle opening sequence.

The selector 22 causes the rotator 21 to turn by the tabs 221 of the selector 22 being meshed with the semicircular slots 212 of the rotator body 21. As the rotator assembly 20 rotates, the activation button of switch 44 drops off protruding lip 211 into the V-shaped cutouts 213 of the rotator 21, so that switch 44 is disengaged. The controlling circuitry (a PCB, not shown) is set to enable the drive mechanism when start switch 44 is disengaged, so that drive motor 40 is started.

The plunger assembly 12 drives the plunger 13 downward onto spring retainer 23, which in turn drives the rotator assembly 20 with rotator 21 downward until the top surface grip 26 comes into contact with the top of the bottle cap 401 on the pill bottle 4. The plunger 13 continues to drive downward, so that pressure is applied to the cap 401. As the plunger 13 continues to drive downward, the half round members 134 of the plunger 13 track along the V-shaped cutouts 213 of the rotator 21, causing the rotator 21 to rotate relative to the plunger 13 while pressure is being applied to the top of the bottle cap 401.

As the top gripping surface 26 of the rotator 21 grips the bottle cap 401, the plunger 13 continues to compress rotator spring 24 and rotate the rotator 21 so that the cap 401 turns with the rotator 21. As pressure is applied to the top of the cap 401, frictional contact of the bottom of the bottle body 402 with the lower gripping surface 43 inhibits the body of the bottle 4 from rotating relative to the casing 10, 11.

When the half round members 134 of the plunger 13 reach the bottom of the V-shaped cutouts 213 of the rotator 21, further downward travel of the plunger 13 is prohibited. As shaft 14 continues to rotate, resultant upward pressure is exerted on the washer 15. The upward force eventually exceeds the pressure rating of the overload spring 16, so that spring 16 is compressed. Clearly, it is imperative to choose overload spring 16 with characteristics that allow it to not be compressed until the half round members 134 of the plunger 13 reach the bottom of the V-shaped cutouts 213 of the rotator 21.

When the overload spring 16 is compressed, the bottle cap 401 having been unlatched from the bottle 4, washer 15 contacts and triggers reverse switch 45. This reverses the drive motor 40 so that plunger 13 begins to retract toward its original position. When the plunger 13 reaches the top of its stroke, the plunger tab 133 engages the stop switch 46, thereby stopping drive motor 40. At this point, the plunger assembly 12 and the rotator assembly 20 are in their original positions. The selector 22 is returned to a neutral central position, again engaging start switch 44. Cycling will not recommence until start switch 44 is disengaged.

The automated pill bottle opener 8 of the present invention also provides the user with the capability of putting the cap 401 back on the pill bottle 4 as well. To do so, the user simply places the bottle 4 to be capped on the lower gripping surface 46 with the cap 401 positioned on the top of the bottle 4. The user then moves the selector tab in a second direction (to the right in the preferred embodiment) to initiate the closing process. The motion of the plunger 13 during the capping process is identical to the plunger 13 motion during the opening process, but the direction of rotation of the rotator 21 is reversed so that the cap 401 is latched back onto the bottle 4.

The above disclosure is not intended as limiting. Those skilled in the art will readily observe that numerous modifications and alterations of the device may be made while retaining the teachings of the invention. Accordingly, the above disclosure should be construed as limited only by the restrictions of the appended claims.

I claim:

1. An automated bottle opener comprising:

a casing with a receiving area to receive a bottle, a plunger assembly to apply downward pressure on a top of a bottle cap of said bottle, and a rotator assembly to rotate said bottle cap; wherein said casing comprises a means to secure a bottom of said bottle, and said rotator assembly comprises a means to secure said top of said bottle cap; such that during an opening process initiated by a user moving a selector in a first direction, a body of said bottle is prevented from rotating, and said rotator assembly rotates said bottle cap while said plunger assembly simultaneously applies pressure to said top of said bottle cap, thereby removing said bottle cap from said bottle, and during a closing process, a direction of rotation of said rotator assembly is reversed by moving said selector in a second direction, such that said bottle cap is replaced onto said bottle.

2. The bottle opener as defined in claim 1 wherein:

motive power is supplied to said bottle opener by an electric motor in communication with said plunger assembly by means of a gear drive.

3. The bottle opener as defined in claim 2 wherein:

said plunger assembly comprises a means to prevent said plunger from rotating relative to said casing.

4. The bottle opener as defined in claim 1 wherein:

said plunger assembly comprises a means to prevent said plunger from rotating relative to said casing.

5. The bottle opener as defined in claim 1 wherein:

when said plunger assembly reaches limit of a downward travel path, a central shaft is pushed upward, and when upward pressure overcomes an overload spring, a reverse switch is triggered, thereby reversing direction of rotation of said rotator assembly.

6. The bottle opener as defined in claim 1 wherein:

said rotator assembly comprises a rotator body with a pair of V-shaped cutouts therein; and tracking elements of said plunger assembly traverse said V-shaped cutouts to define a stroke of said plunger, said tracking elements causing upward pressure on a drive shaft of said plunger assembly when said tracking elements reach a bottom of said V-shaped cutouts.

7. The bottle opener as defined in claim 1 wherein:

said plunger assembly is in communication with said rotator assembly through a rotator spring, such that said rotator spring is compressed after an upper gripping surface of said rotator contacts a top surface of said bottle cap, thereby enabling said plunger to continue to exert downward pressure on said bottle cap while said rotator assembly rotates said bottle cap.

* * * * *